US008220230B2

(12) United States Patent
Su et al.

(10) Patent No.: US 8,220,230 B2
(45) Date of Patent: Jul. 17, 2012

(54) CABLE BUNDLING DEVICE

(75) Inventors: Kuo-Fu Su, Taoyuan County (TW); Gwun-Jin Lin, Taoyuan County (TW); Chih-Heng Chuo, Taoyuan County (TW)

(73) Assignee: Advanced Flexible Circuits Co., Ltd., Taoyuan County (TW)

( * ) Notice: Subject to any disclaimer, the term of this patent is extended or adjusted under 35 U.S.C. 154(b) by 178 days.

(21) Appl. No.: 12/764,403

(22) Filed: Apr. 21, 2010

(65) Prior Publication Data

US 2011/0197553 A1 Aug. 18, 2011

(30) Foreign Application Priority Data

Feb. 12, 2010 (TW) ..... 99104554 A

(51) Int. Cl.

| | |
|---|---|
| ***B65B 13/10*** | (2006.01) |
| ***B65B 13/12*** | (2006.01) |
| ***B65B 11/02*** | (2006.01) |
| ***B65B 11/04*** | (2006.01) |
| ***B65B 27/10*** | (2006.01) |

(52) U.S. Cl. ..... 53/587; 53/588; 100/13; 100/15; 100/27

(58) Field of Classification Search ..... 53/587, 53/588; 100/13, 15, 27; *B65B 11/04, 13/02, B65B 13/10, 13/12, 27/10*

See application file for complete search history.

(56) References Cited

U.S. PATENT DOCUMENTS

| | | | | | |
|---|---|---|---|---|---|
| 852,337 | A | * | 4/1907 | Marks | 100/13 |
| 986,690 | A | * | 3/1911 | Clark | 100/27 |
| 1,420,677 | A | * | 6/1922 | Ardizzoni | 100/13 |
| 1,807,869 | A | * | 6/1931 | Okey | 53/587 |
| 1,848,254 | A | * | 3/1932 | Johnson | 100/13 |
| 2,074,892 | A | * | 3/1937 | Derry | 53/588 |
| 2,085,082 | A | * | 6/1937 | Delany | 100/13 |
| 4,173,108 | A | * | 11/1979 | Eglinton et al. | 53/587 |
| 4,461,136 | A | * | 7/1984 | Hudson et al. | 53/587 |
| 4,628,671 | A | * | 12/1986 | Storm et al. | 53/588 |
| 5,287,678 | A | * | 2/1994 | Leitzel | 53/587 |
| 5,606,909 | A | * | 3/1997 | Ohta et al. | 100/8 |
| 5,799,466 | A | * | 9/1998 | Underhill | 53/587 |
| 6,539,850 | B1 | * | 4/2003 | Parker | 100/3 |

FOREIGN PATENT DOCUMENTS

| | | | | |
|---|---|---|---|---|
| DE | 3844159 | A1 | * | 6/1990 |
| FR | 2626550 | A1 | * | 8/1989 |
| FR | 2757132 | A1 | * | 6/1998 |
| JP | 54094989 | A | * | 7/1979 |
| JP | 06345038 | A | * | 12/1994 |

* cited by examiner

*Primary Examiner* — Stephen F Gerrity
(74) *Attorney, Agent, or Firm* — Rosenberg, Klein & Lee

(57) ABSTRACT

A cable bundling device includes a cable positioning and a wrapping mechanism. The cable positioning mechanism includes a first clamping member and a second clamping member, which are set in a working zone. The first and second clamping members function to respectively clamp ends of a cable. One of the wrapping mechanism and the cable positioning mechanism is selectively rotatable to have the bundling material loaded in the wrapping mechanism wrapped around the cable.

10 Claims, 10 Drawing Sheets

CABLE BUNDLING DEVICE

FIELD OF THE INVENTION

The present invention relates to the design of a bundling device, and in particular to cable bundling device that bundles a cable by wrapping a bundling material around the cable.

BACKGROUND OF THE INVENTION

Recently, flexible circuit board technology has found applications in ribbon cables. The flexible circuit board based ribbon cable products that are commonly available in the market are often of a circuit board structure comprising a single-sided board, a double-sided board, or a multi-layer board, depending on the number of transmission lines required.

In certain currently prevailing consumer electronic devices, such as notebook computers, liquid crystal displays, digital cameras, mobile phones, and touch panels, and a number of other consumer electronic products, a cover or a display screen is often coupled to a device body of the electronic device with a hinge structure. To transmit electrical signals from the body of the electronic device to the cover or the display screen, a commonly adopted solution is connecting therebetween a transmission line that is constituted by for example a miniaturized ribbon cable or a bundled cluster of tiny wire harness. In such fields of application, the present applicant previously proposed a flexible circuit board based ribbon cable that is composed of a cluster section and a bundled flexible circuit based ribbon cable having a foldable structure, wherein the cluster section is composed of a cluster of multiple transmission lines or cables/wires that are formed by slitting the flexible substrate in a direction along which the substrate is extended.

For the flexible circuit board based ribbon cable that has a bundled structure and/or a cluster section, the cable needs to be handled in a subsequent process by setting a bundling structure around the cluster section or a selected portion of the cluster section to form the bundled structure. During the course of bundling the cluster section, conventionally, manual operation and intervention is required.

SUMMARY OF THE INVENTION

However, the progress of technology and science makes it possible for consumers to desire better quality of products. Manual operation of setting a bundling structure on the cluster section, or a selected portion thereof, of a flexible circuit board based ribbon cable to form a bundled structure often leads to inconsistent quality of the final products of ribbon cables. Further, manual operation may also causes degraded performance of production due to human factors and consequently, the performance of production is inconsistent, making it impossible to effectively improve the performance and throughput of production.

Further, a known machine that is used to bundle a flexible circuit board based ribbon cable is of a complicated structure that is composed of a great number of components/parts and is only applicable to ribbon cables of a fixed length, meaning the length of ribbon cables to be processed by the machine must be fixed and is not allowed to vary, so that the machine has only a very limited range of application. Further, the operation of such a known machine is quite time- and labor-consuming and is difficult. In addition, the bundling operation carried out with such a known machine often leads to irregularity and disorder of the bundled cable, so that the performance and effectiveness of the cable are affected. Further, the operation of such a known machine cannot be automatized, and is operated in such a low speed, non-adjustable, and hard to control manner. Consequently, the manufacturing expense is raised, making it not economically effective and showing low market competition power. Such drawbacks of the known machine have troubled the industry for quite a long time and a solution to effectively improve the operation performance of a machine of this kind and enhance the value of the product thereof is desired in this industry. This is the motivation of the development of the present invention.

Thus, an objective of the present invention is to provide a cable bundling device that overcomes the drawbacks occurring in the known, manually-operated cable bundling machines.

The solution adopted in the present invention to overcome the problems of the conventional techniques comprises a cable bundling device, which functions to wraps at least one bundling material around at least one cable. The cable bundling device comprises a track assembly, a rotation mechanism, a cable positioning mechanism, a wrapping mechanism, and a cable collection mechanism. The track assembly comprises a track and a slide and is selectively driven by at least one drive unit. The slide is slidably mounted to the track to be movable in an axial movement direction. The rotation mechanism comprises a support base and a rotary unit. The support base is mounted to the slide of the track assembly. The rotary unit is coupled to a predetermined position on the support base through a transmission assembly and is driven through the transmission assembly to rotate about a center axis in a rotation direction. The rotary unit, the transmission assembly, and the support base commonly define a through hole having a predetermined diameter in the center axis and the through hole defines a working zone along the axial movement direction. A cable to be processed is clamped and held in position by clamping members of the cable positioning mechanism.

The wrapping mechanism is mounted on the rotary unit at a location adjacent to the working zone and is loaded with a bundling material. The rotary unit of the rotation mechanism is provided with an angle adjustment member that is mounted at a location adjacent to the wrapping mechanism and is coupled to a carriage for adjusting an angular position of the carriage and rollers mounted on the carriage with respect to the cable clamped in the working zone.

When the slide of the track assembly is moved on the track in the axial movement direction, the rotary unit of the rotation mechanism and the wrapping mechanism are caused to rotate in the rotation direction. When the through hole of the rotation mechanism is moved to pass over the cable located in the working zone, the rollers of the wrapping mechanism have a bundling material contact surface that applies the bundling material to wind and wrap around the cable. The cable collection mechanism functions to manage the cable before the bundling material is wrapped around the cable.

In a different embodiment of the present invention, a cable to be processed is set in rotation, while the bundling material is kept stationary without rotation and the same result of wrapping the bundling material around a cable can be obtained.

With the solution provided by the present invention, bundling speed and location can be adjusted and properly controlled in the bundling operation in an automatic manner, whereby advantages of high-speed and regular and ordered bundling with consistent quality can be realized in wrapping a bundling material around a cluster section, or a selected portion thereof, of a flexible circuit board based ribbon cable to form a bundled structure. The drawback of poor performance occurring in the conventional human based operation, which leads to inconsistency of performance of production and makes it impossible to improve the efficiency and throughput of the conventional ways, can be eliminated.

Further, the cable collection mechanism adopted in the present invention functions to manage a cable to be processed before the bundling material is wrapped around the cable, and this helps preventing the cable, or portions of the cable, from distributed in a random and disordered manner and also enhances aesthetics of the bundling.

Further, as compared to the conventional machines, the cable bundling device according to the present invention offers a simplified structure and can be automatized to reduce the manufacturing costs, making it economic effective and improving market competition power.

The cable bundling device according to the present invention finds wide practical applications in industries. The applications may include regular flexible electronic circuits, such as flexible ribbon cables having a cluster section, thin-film printed electronic ribbon cables, flexible flat cables (FFC), flexible printed circuit boards (FPC), electronic cables, Teflon cables, and coaxial cables. Further, the bundling device of the present invention can be used in bundling regular electronic ribbon cables without conductor lines and cables without conductor lines. The bundling operation carried out with the present invention may provide a bundled cable with a cross-section of a circular, square, or rectangular shape or any other shapes.

BRIEF DESCRIPTION OF THE DRAWINGS

The present invention will be apparent to those skilled in the art by reading the following description of preferred embodiments of the present invention, with reference to the attached drawings, in which.

DETAILED DESCRIPTION OF THE PREFERRED EMBODIMENTS

Figure 1:
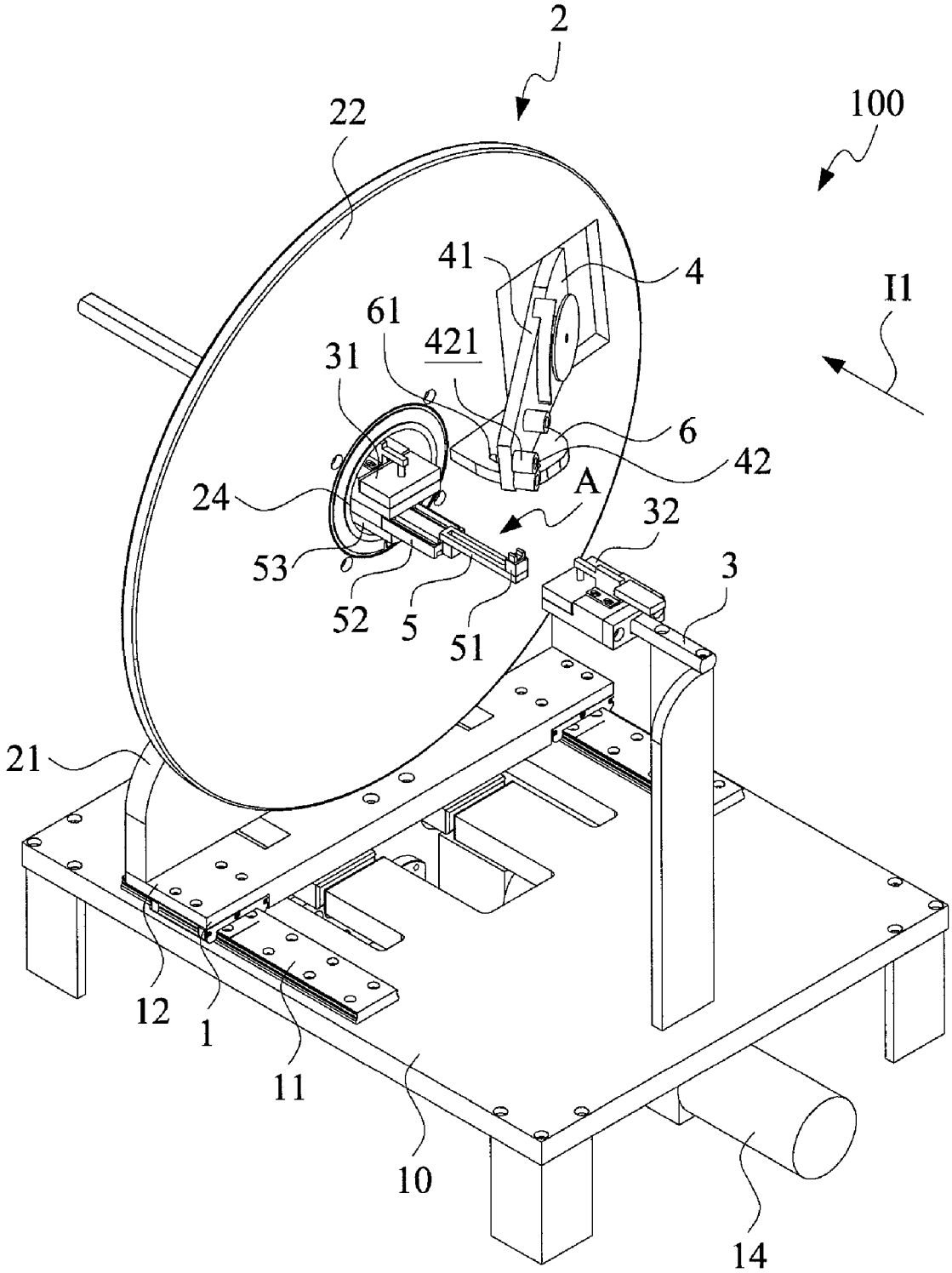
FIG. 1 is a perspective view of a cable bundling device constructed in accordance with a first embodiment of the present invention.
Figure 2:
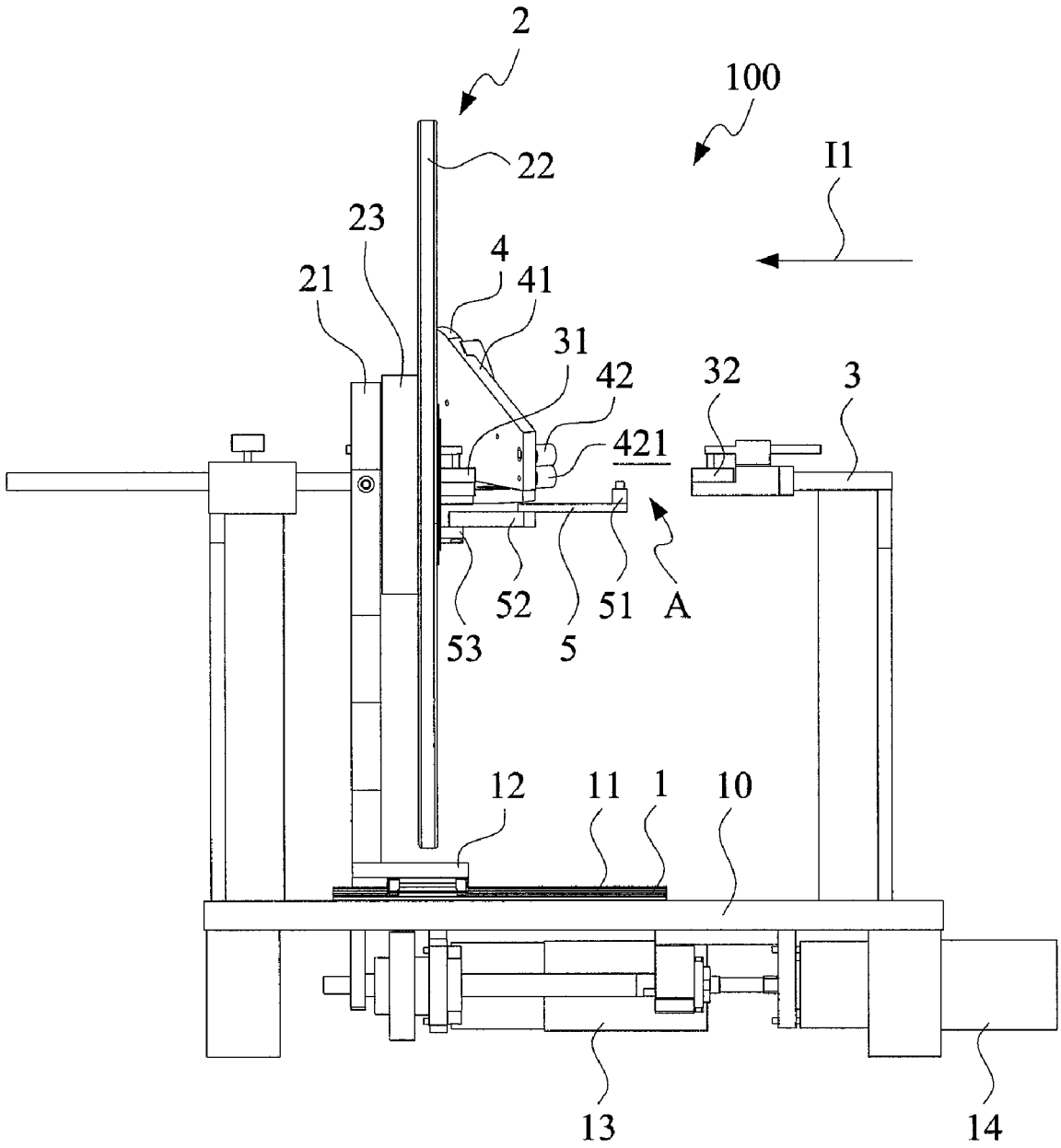
FIG. 2 is a side elevational view of the cable bundling device according to the first embodiment of the present invention.

With reference to the drawings and in particular to FIGS. 1 and 2, a cable bundling device constructed in accordance with a first embodiment of the present invention, generally designated at 100, comprises a track assembly 1, a rotation mechanism 2, a cable positioning mechanism 3, and a wrapping mechanism 4. The track assembly 1 comprises a track 11 mounted on a chassis 10 and a slide 12, which is slidably mounted to the track 11. The slide 12 is coupled to a drive unit 13, and the slide 12 can be driven by the drive unit 13 to slide on the track 11 in an axial movement direction 11.

The rotation mechanism 2 comprises a support base 21 and a rotary unit 22. The support base 21 is mounted to the slide 12 of the track assembly 1. The rotary unit 22 is coupled to a predetermined position on the support base 21 through a transmission assembly 23. In the instant embodiment, the rotary unit 22 comprises a rotatable wheel. The transmission assembly 23 is driven by a drive unit 14 to rotate. The support base 21 then serves as a support to the wheel axis. As shown, the rotary unit 22, the transmission assembly 23, and the support base 21 commonly define a through hole 24 having a predetermined diameter in a center axis and the through hole 24 defines a working zone A along the axial movement direction 11.

The cable positioning mechanism 3 comprises a first clamping member 31 and a second clamping member 32. The first clamping member 31 is set at one end of the working zone A, and the second clamping member 32 is set at an end of the working zone A that is opposite to the first clamping member 31. The first clamping member 31 and the second clamping member 32 serve to clamp and hold a cable 7 to be processed at the opposite ends of the working zone A.

As shown, the wrapping mechanism 4 is mounted on the rotary unit 22 at a location adjacent to the working zone A. The wrapping mechanism 4 comprises a carriage 41 and one or more rollers 42 mounted to an end of the carriage 41. The carriage 41 is mounted to the rotary unit 22 of the rotation mechanism 2 to be movable within a predetermined range and functions to provide and wind a bundling material. According to the present invention, a bundling material contact surface 421 is defined on a surface of the rollers 42, whereby the bundling material carried on the carriage 41 is guided by the bundling material contact surface 421 of the rollers 42 to wind and wrap around an outer surface of the cable 7 that is clamped in the working zone A.

An angle adjustment member 6 is mounted on the rotary unit 22 of the rotation mechanism 2 and adjacent to the wrapping mechanism 4. The angle adjustment member 6 is coupled to the carriage 41 for adjusting the carriage 41 and the rollers 42 mounted on the carriage 41. With adjustment performed through the angle adjustment member 6, an angular position with respect to the cable clamped in the working zone A is adjusted. As shown in FIGS. 1 and 2, the angle adjustment member 6 comprises a horizontal structure that defines a slot 61 extending in a direction substantially corresponding to the axial movement direction 11. A positioning peg or bolt (not shown) extends upwards from the underside through the slot 61 to engage a free end portion of the carriage 41, whereby the free end portion of the carriage 41 is adjustable through moving along the slot 61.

In the instant embodiment, a cable collection mechanism 5 is further included, comprising a cable collection member 51, at least one cable collection member extender 52, and a cable collection mechanism retainer 53. The cable collection member extender 52 is coupled to both the cable collection member 51 and the cable collection mechanism retainer 53. The cable collection mechanism retainer 53 extends through the through hole 24 of the rotation mechanism 2 and is fixed to the support base 21. The cable collection member 51 extends into the working zone A, functioning to manage a cable before a bundling material is wrapped around the cable.

Figure 3:
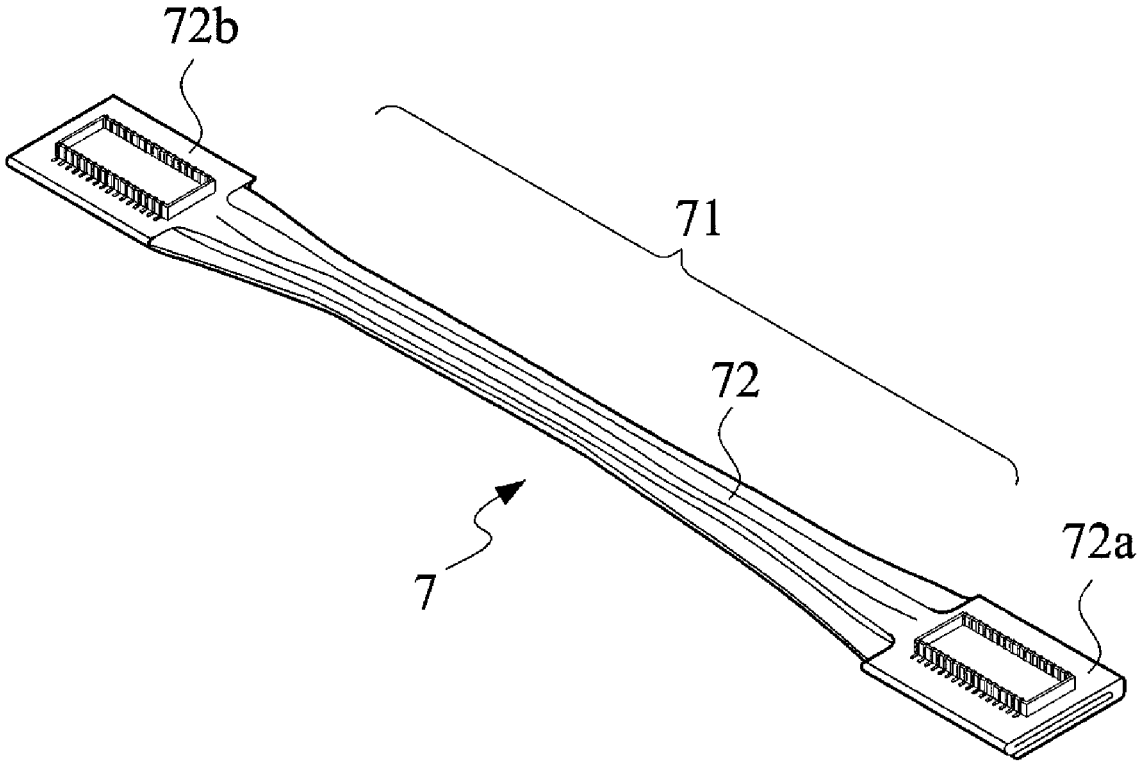
FIG. 3 is a perspective view showing a cable to be processed by the cable bundling device of the present invention, the cable being a flexible ribbon cable having a cluster section.
Figure 4:
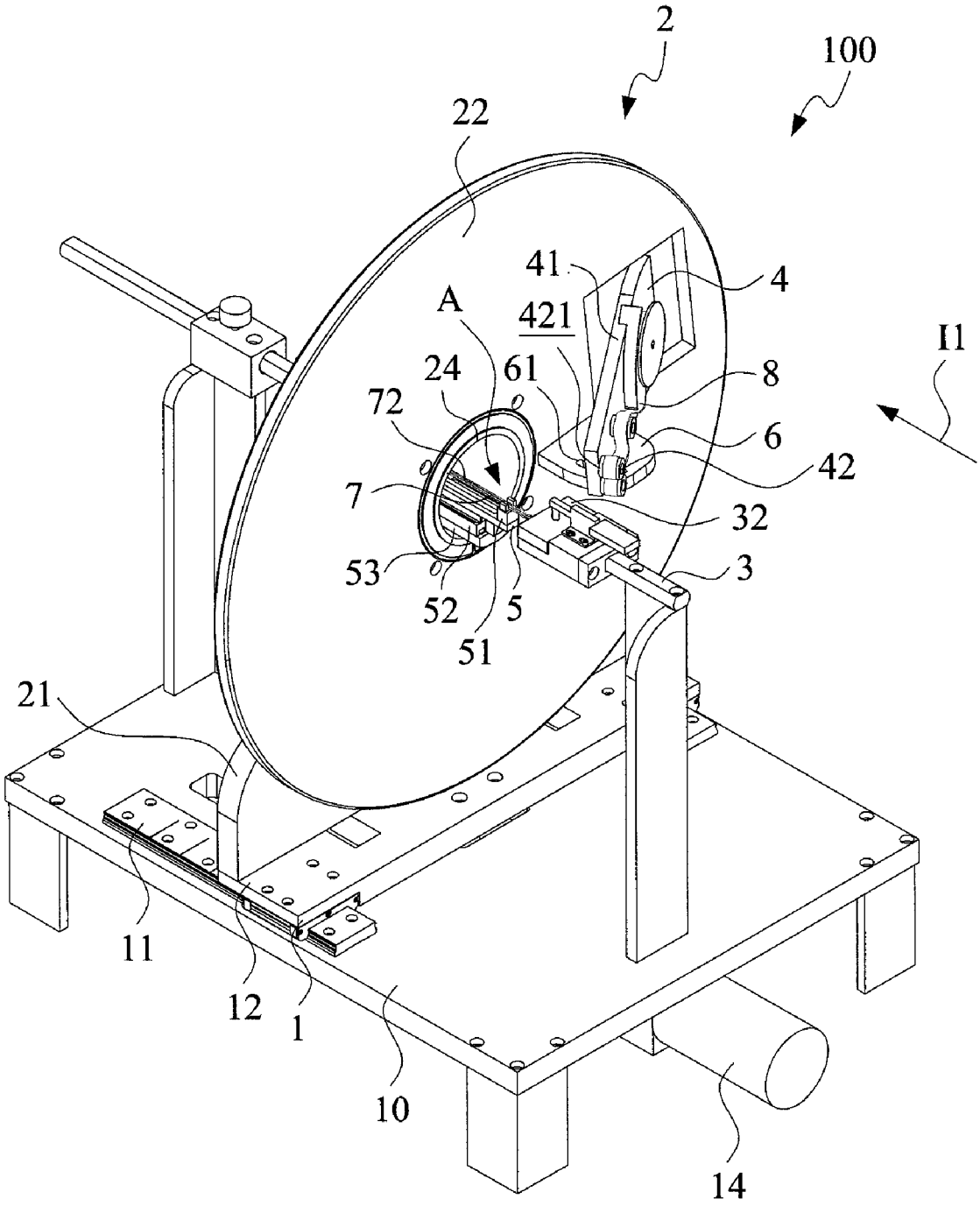
FIG. 4 is a perspective view showing cable ends of the cable to be processed being clamped and held in position by first and second clamping members of a cable positioning mechanism of the cable bundling device of the present invention.
Figure 5:
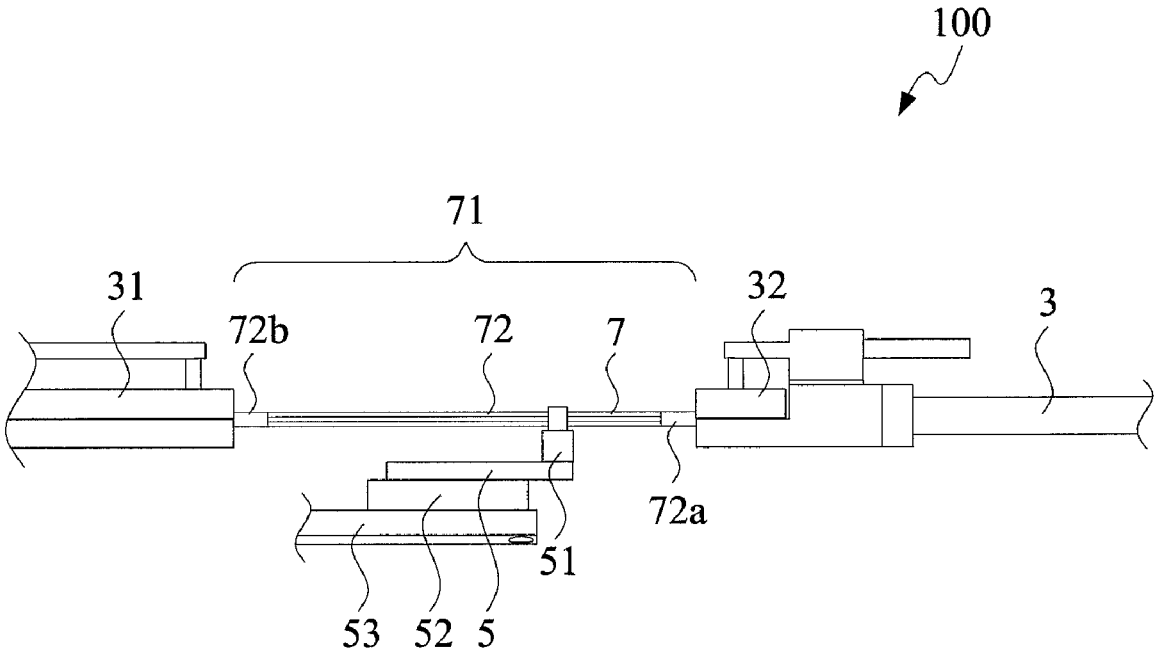
FIG. 5 is a side elevational view showing the cable ends of the cable to be processed being clamped and held in position by the first and second clamping members of the cable positioning mechanism of the cable bundling device of the present invention.

Referring to FIGS. 3-5, a cable 7 to be processed can be a flexible electronic circuit board comprising a cluster section 71. The cluster section 71 is composed of a plurality of ribbon cables 72 clustered together. Each ribbon cable 72 comprises an independent and non-constrained flexible feature for clustering (as shown in FIG. 3). The cable 7 to be processed has cable ends 72*a*, 72*b* respectively positioned on the first clamping member 31 and the second clamping member 32 of the cable positioning mechanism 3 (as shown in FIGS. 4 and 5). The clustered ribbon cables 72 of the cable 7 are received in the cable collection member 51 of the cable collection mechanism 5. The carriage 41 of the wrapping mechanism 4 is loaded with a bundling material 8 in advance. The bundling material 8 can be for example a protective sheet, an insulation sheet, an electromagnetic shielding sheet, or an electrically conductive fabric.

Besides a flexible ribbon cable having a cluster section, the cable 7 to be process can also be a regular flexible electronic circuit ribbon cable, including for example a thin-film printed electronic ribbon cable, a flexible flat cable (FFC), a flex printed circuit board (FPC), an electronic cable, a Teflon cable, and a coaxial cable. These flexible electronic circuits contain therein conductor lines for transmission of electronic signals. It is apparent that the present invention is also applicable to bundling of any cable that contains no conductor line therein. A cable, after being bundled with the bundling device of the present invention, may show a cross-section having a circular, square, or rectangular shape, or any other shapes.

Figure 6:
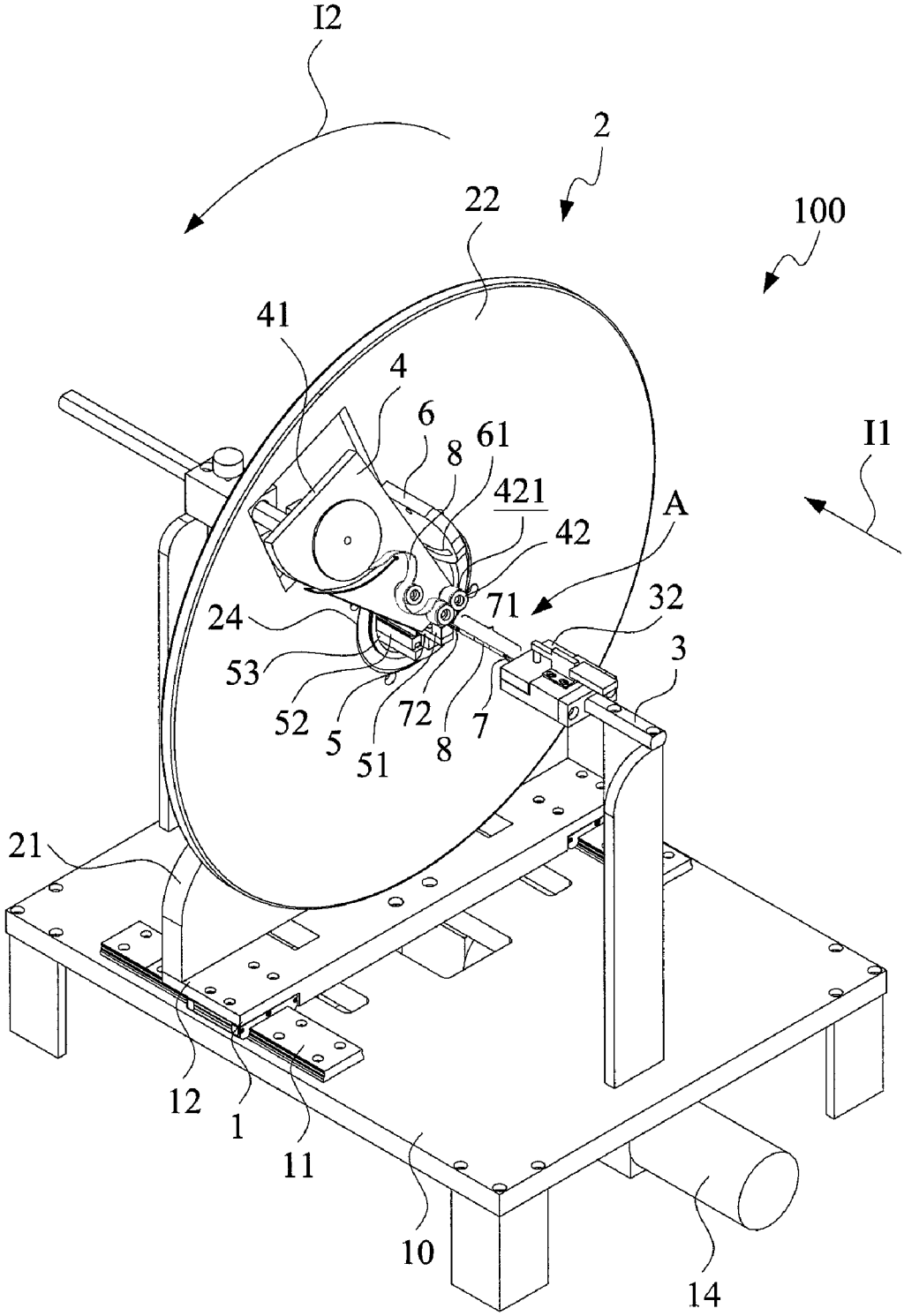
FIG. 6 is a perspective view showing a first phase of a bundling operation carried out by the cable bundling device of the first embodiment of the present invention.
Figure 7:
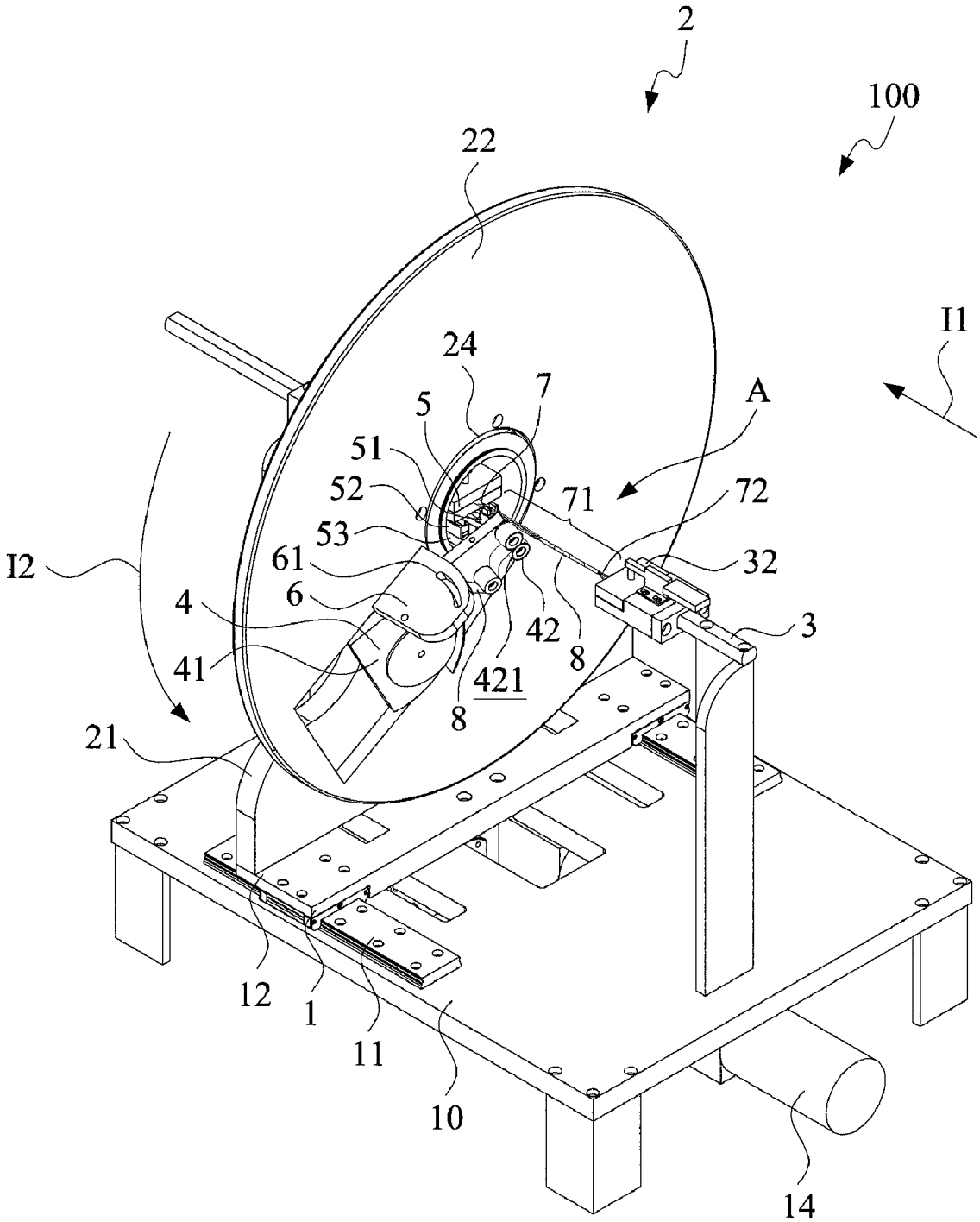
FIG. 7 is a perspective view showing a second phase of the bundling operation carried out by the cable bundling device of the first embodiment of the present invention.
Figure 8:
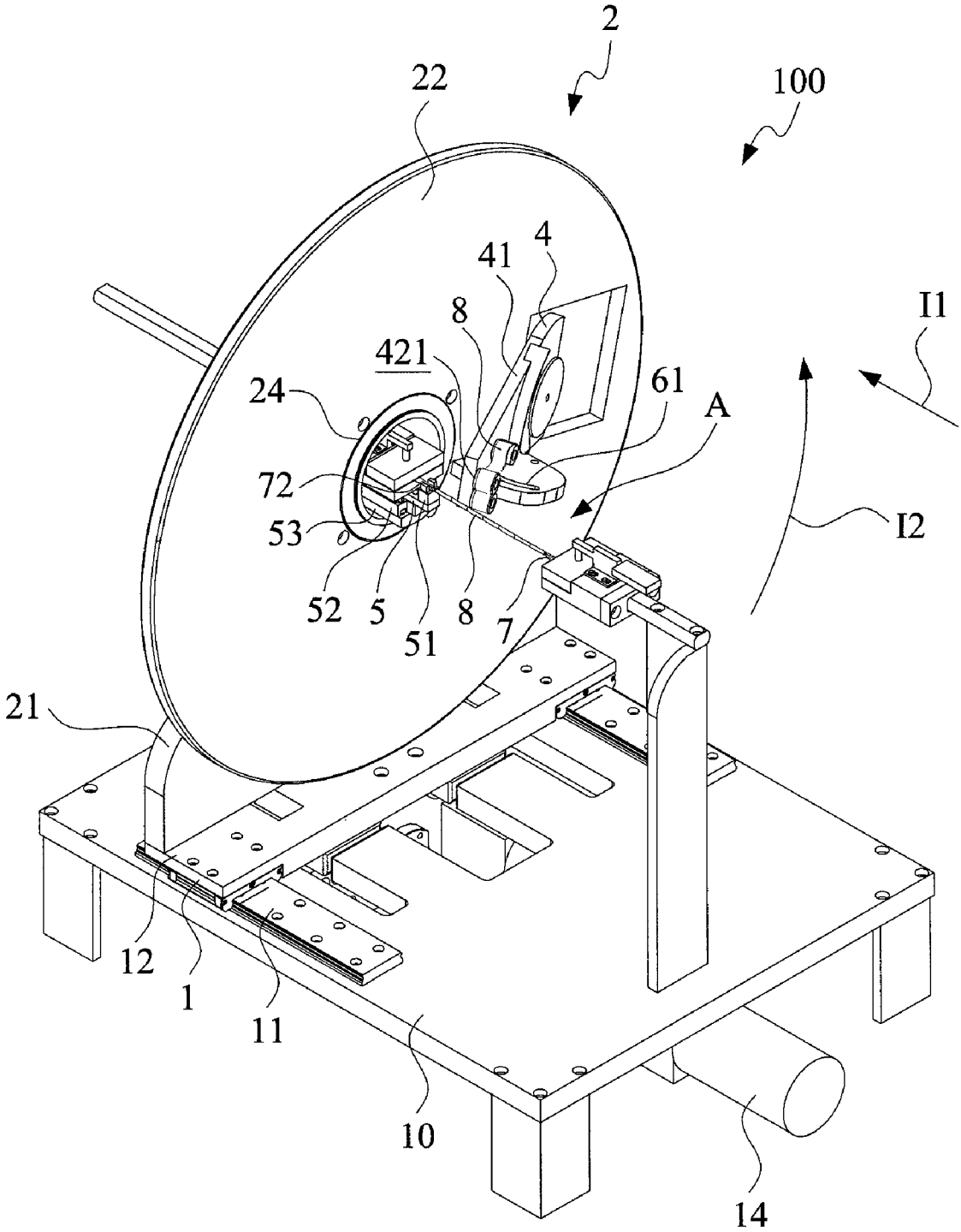
FIG. 8 is a perspective view showing a third phase of the bundling operation carried out by the cable bundling device of the first embodiment of the present invention.
Figure 9:
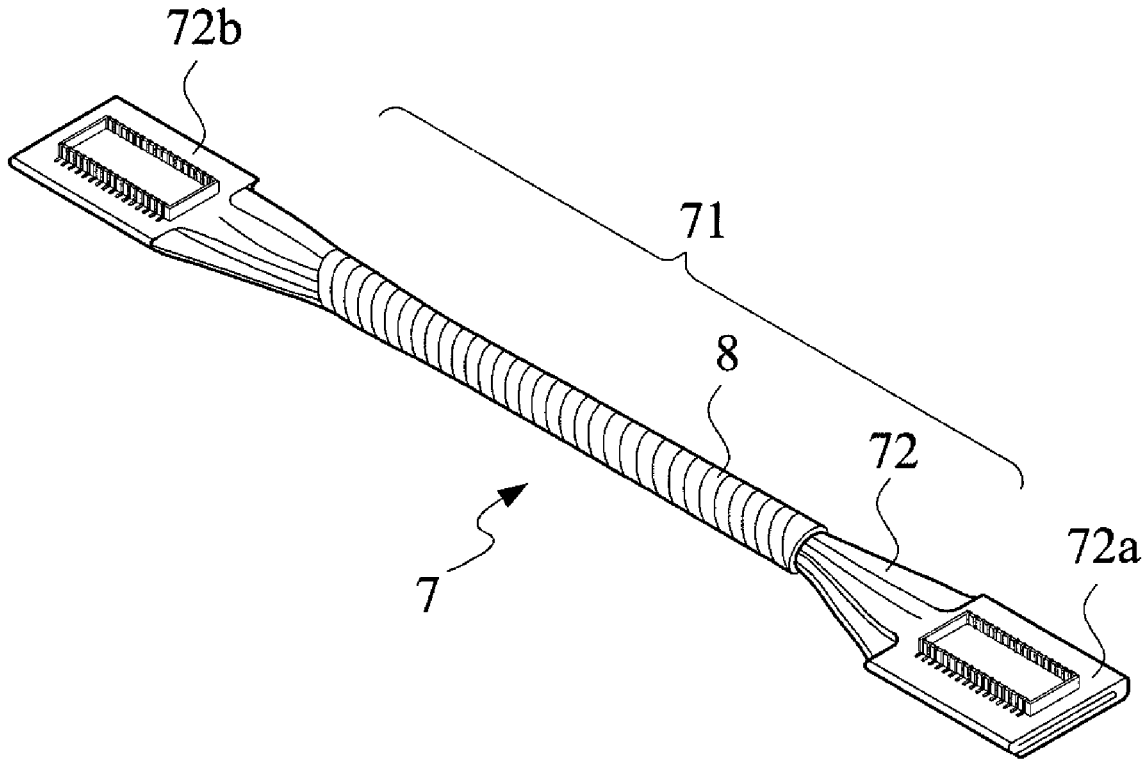
FIG. 9 is a perspective view showing a cable that is bundled by wrapping a bundling material thereon by the cable bundling device of the present invention.

Referring to FIGS. 6-8, to perform the bundling operation of a cable 7, the slide 12, after being driven by the drive unit 13, is first moved along the track 11 in a direction opposite to the axial movement direction 11 so as to move the rotation mechanism 2 to a location close to the second clamping member 32 (see FIG. 6). Afterwards, the drive unit 13 drives the slide 12 to steadily moves in the axial movement direction 11 to approach the first clamping member 31 (see FIGS. 7 and 8). Meanwhile, the transmission assembly 23 of the rotation mechanism 2 causes the rotary unit 22 to rotate in a rotation direction 12, making the wrapping mechanism 4 that is mounted to the rotary unit 22 rotating in unison with the rotary unit 22 in the rotation direction 12, whereby the bundling material 8 that is set around the rollers 42 in advance is wrapped around the cable 7. FIG. 9 is a perspective view of the cable 7 after the bundling material 8 is wrapped around the cable 7.

When the bundling material 8 is being wrapped around the cable 7, since the cable collection member 51 of the cable collection mechanism 5 is movable in the axial movement direction 11 with the support base 21, the cable collection member 51 can concentrate and manage the ribbon cables 72 of the cable 7 before the cable 7 is wrapped around by the bundling material 8, so as to prevent the cable 7 from arbitrarily and disorderly separated, which adversely affects the functionality and aesthetics of the bundling.

Figure 10:
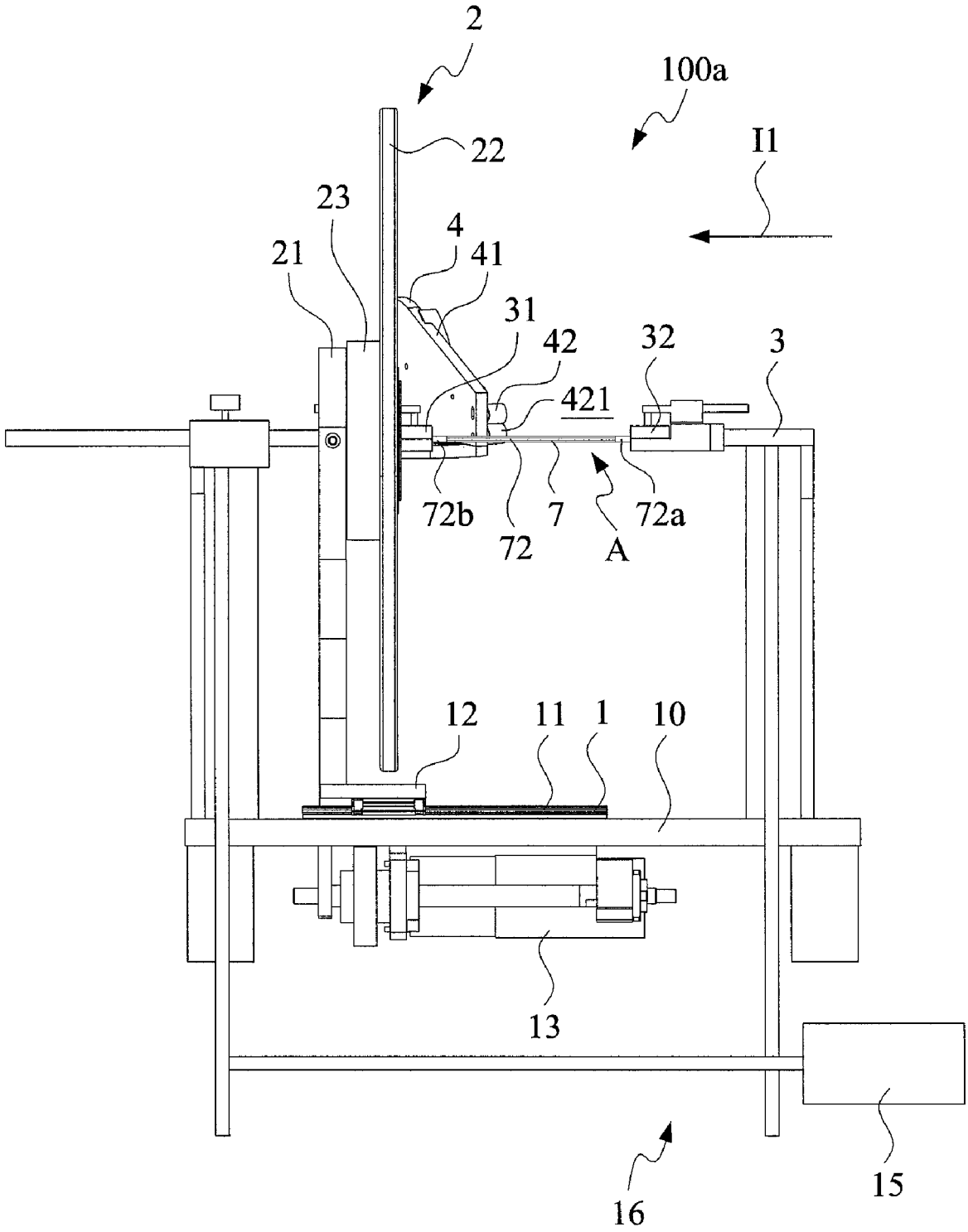
FIG. 10 is a schematic view showing a cable bundling device constructed in accordance with a second embodiment of the present invention.

In the first embodiment of the present invention that was described previously, the cable 7 to be processed 7 is clamped and securely held by the first clamping member 31 and the second clamping member 32, while the rotary unit 22 of the rotation mechanism 2 is set to rotate about the cable 7 to wind and wrap the bundling material 8 around the cable 7. In a second embodiment according to the present invention, a cable bundling device 100*a* is constructed to allow the cable 7 to be processed to rotate, while the bundling material 8 is held in a fixed position without rotation. This arrangement provides the same result of winding and wrapping the bundling material 8 around the cable 7. Referring to FIG. 10, opposite ends of the cable 7 to be processed are respectively clamped and held by a first clamping member 31 and a second clamping member 32, and a drive unit 15 drives, through a known transmission assembly 16 (such as a transmission rod or a belt), the first clamping member 31 and the second clamping member 32 to simultaneously rotate. A wrapping mechanism 4 is set at a predetermined location on a positioning unit, whereby when the cable 7 to be processed is rotated by both the first clamping member 31 and the second clamping member 32, a bundling material 8 that is loaded in the wrapping mechanism 4 is wrapped around the cable 7.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A cable bundling device adapted to wind and wrap a bundling material around a cable, the cable bundling device comprises:

a cable positioning mechanism, which comprises a first clamping member and a second clamping member, the first clamping member being located at a first end of a working zone, the second clamping member being located at a second end of the working zone that is opposite to the first clamping member, the first clamping member and the second clamping member being adapted to respectively clamp cable ends of the cable;

a wrapping mechanism, which is loaded with the bundling material, the wrapping mechanism being rotatable;

a track assembly, which comprises a track and a slide, the slide being slidably mounted to the track to be movable in an axial movement direction; and a rotation mechanism, which comprises:

a support base, which is mounted to the slide of the track assembly, and a rotary unit, which is coupled to a predetermined location of the support base through a transmission assembly, so as to be driven through the transmission assembly to rotate in a rotation direction about a center axis, the rotary unit, the transmission assembly, and the support base commonly defining a through hole having a predetermined diameter in the center axis, the through hole defining the working zone along the axial movement direction;

wherein the wrapping mechanism is mounted on the rotary unit at a location adjacent to the working zone;

wherein when the slide of the track assembly moves along the track in the axial movement direction, the rotary unit of the rotation mechanism and the wrapping mechanism are in rotation in the rotation direction, whereby with the through hole of the rotary unit being moved over the cable located in the working zone, the wrapping mechanism winds and wraps the bundling material around the cable; and wherein one of the wrapping mechanism and the cable positioning mechanism is selectively rotatable to have the bundling material wrapped around the cable.

2. The cable bundling device as claimed in claim 1, wherein the cable positioning mechanism is rotatable.

3. The cable bundling device as claimed in claim 1 further comprising a cable collection mechanism, which comprises a cable collection member, at least one cable collection member extender, and a cable collection mechanism retainer, wherein the cable collection member extender is coupled to both the cable collection member and the cable collection mechanism retainer, the cable collection mechanism retainer extending through the through hole defined in the rotary unit of the rotation mechanism, the transmission assembly, and the support base and fixed to the support base, the cable collection member positionable in the working zone, whereby the cable collection member functions to collect the cable when the bundling material is being wrapped around the cable.

4. The cable bundling device as claimed in claim 1, wherein the wrapping mechanism comprises a carriage, which is mounted to the rotary unit of the rotation mechanism to be movable within a given range and is loaded with the bundling material.

5. The cable bundling device as claimed in claim 1 further comprising an angle adjustment member, which is mounted on the rotary unit of the rotation mechanism and adjacent to the wrapping mechanism, the angle adjustment member being coupled to the carriage for adjusting the carriage and rollers mounted to the carriage, whereby the cable clamped in the working zone is adjustable in angular position thereof.

6. The cable bundling device as claimed in claim 1, wherein the bundling material is selected from the group consisting of a protective sheet, an insulation sheet, an electromagnetic shielding sheet, and an electrically conductive fabric.

7. The cable bundling device as claimed in claim 1, wherein the cable comprises a flexible ribbon cable comprising a cluster section, the cluster section being composed of a plurality of ribbon cables clustered together, each of the ribbon cables comprising an independent and non-constrained flexible feature for clustering.

8. The cable bundling device as claimed in claim 1, wherein the cable is selected from the group consisting of an electronic circuit showing electrical conductivity, an electronic ribbon cable containing no conductor line of electrical conductivity, and a cable containing no conductor line.

9. The cable bundling device as claimed in claim 8, wherein the electronic ribbon cable of electronic circuit conductor lines showing electrical conductivity is selected from the group consisting of a thin-film printed electronic ribbon cable, a flexible flat cable, a flexible printed circuit board, an electronic cable, a Teflon cable, and a coaxial cable.

10. The cable bundling device as claimed in claim 1, wherein the cable shows a cross-section selected from the group consisting of a circular, square, or rectangular shape and any other shapes, after being bundled.

* * * * *